US007393067B2

(12) United States Patent
Huang

(10) Patent No.: US 7,393,067 B2
(45) Date of Patent: Jul. 1, 2008

(54) LOCK-CONTROLLED DRAWER SLIDE STRUCTURE

(75) Inventor: Kuo-Sheng Huang, Ying Ghor Town (TW)

(73) Assignee: Nan Juen International Co., Ltd., Taipei County (TW)

( * ) Notice: Subject to any disclaimer, the term of this patent is extended or adjusted under 35 U.S.C. 154(b) by 154 days.

(21) Appl. No.: 11/326,501

(22) Filed: Jan. 6, 2006

(65) Prior Publication Data

US 2007/0159038 A1 Jul. 12, 2007

(51) Int. Cl.
*E05B 53/00* (2006.01)

(52) U.S. Cl. ..... 312/219

(58) Field of Classification Search ..... 312/215, 312/217–219, 221, 222, 333; 70/85–88; 384/21

See application file for complete search history.

(56) References Cited

U.S. PATENT DOCUMENTS 2,966,384 A * 12/1960 Bergman ..... 312/218
3,774,985 A * 11/1973 Chovanec et al. ..... 312/217
3,776,007 A * 12/1973 Himsl ..... 70/86
4,239,309 A * 12/1980 De Fouw et al. ..... 312/221
4,609,233 A * 9/1986 Walla ..... 312/219
4,838,624 A * 6/1989 Walla ..... 312/221
4,925,257 A * 5/1990 Frederiksen et al. ..... 312/221
6,746,091 B2 * 6/2004 Friar et al. ..... 312/218
6,969,129 B2 * 11/2005 Ludwig et al. ..... 312/217
7,104,619 B2 * 9/2006 Ludwig et al. ..... 312/221

* cited by examiner

*Primary Examiner*—Janet M Wilkens
(74) *Attorney, Agent, or Firm*—Troxell Law Office, PLLC

(57) ABSTRACT

A lock-controlled drawer slide structure comprises a lock device, a steel rope, and a latch device, wherein the lock-controlled drawer slide is connected with an interlocking device so as to lock several drawers securely. The lock device comprises a fixing main body, a lock head, a rotatory means, a pull plate, and a fixing plate. The steel rope comprises two fixing heads. The latch device comprises a base, a slidable means, a braking means, a fastening plate, and a cover. The steel rope is utilized to connect the lock device with the latch device securely without the use of complicated fixing structure. The drawers can be locked together by using the braking means that controls the interlocking device. When the braking device is released from being braked by the interlocking device, the braking device retrieves its ability to lock or unlock the upper or lower drawers.

2 Claims, 9 Drawing Sheets

LOCK-CONTROLLED DRAWER SLIDE STRUCTURE

FIELD OF THE INVENTION

The present invention relates to a lock-controlled drawer slide structure, and more particularly to a structure that couples a lock device with an interlocking device for locking the drawers preferably.

BACKGROUND OF THE INVENTION

The drawers are commonly applied to the general office facilities such as storage cabinet, data cabinet, and so forth. Besides, the drawer structures are always attached to the desks for storing or collecting data or articles, thereby increasing their practical utility among family or office facilities.

For the existing stacked drawers that can be pulled out individually, if one of the drawers is pulled out, the other drawer that mounts above or underneath this opened drawer may be pulled out simultaneously. Accordingly, a conventional interlocking device that uses a braking rod to lock the upper or lower drawer is mounted among drawers for preventing the other drawers from being pulled out. Besides, a lock head is mounted on one of these drawers for locking these stacked drawers simultaneously, wherein a stopper is mounted beside every drawer on the same side as the lock head. As a result, when the lock head is rotated by a specific angle, a lock sheet is driven by a connection rod so as to lock these drawers simultaneously.

These drawers are not interlocked securely because the conventional drawer locking structure is not strong enough and an additional connection device must be mounted between the lock head and every drawer.

SUMMARY OF THE INVENTION

A major purpose of the present invention is to provide a lock-controlled drawer slide structure that couples a lock device with an interlocking device such that several drawers can be interlocked securely by using the lock device for controlling the interlocking among the drawers.

It is a main object of the present invention to provide a structure that utilizes a steel rope to couple the lock device with a latch device. The steel rope can be obtained and mounted easily so the lock device and the latch device can be connected to each other easily without the use of complicated fixing structure.

It is another object of the present invention to provide a braking device that controls the interlocking device for interlocking and fixing the drawers. As a result, when the braking device is released from being braked by the interlocking device, the braking device retrieves its ability to lock or unlock the upper or lower drawers.

It is still another object of the present invention to provide a structure having a convenient latch device, wherein the latch device is indirectly fixed on the slide by a fastening plate. As a result, it is very easy to couple and position them.

DETAILED DESCRIPTION OF THE PREFERRED EMBODIMENT

Figure 1:
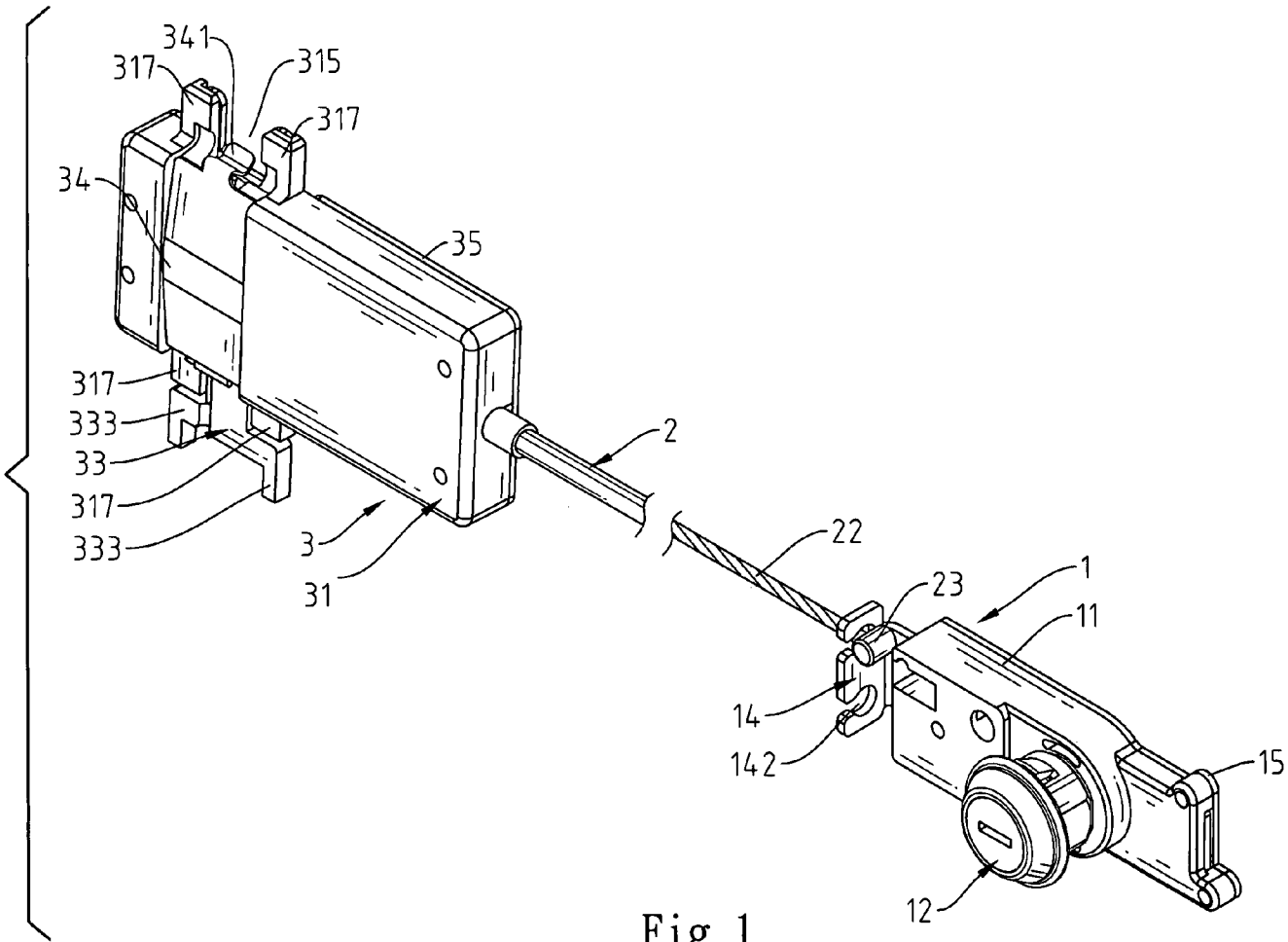
FIG. 1 is a three-dimensional view showing the preferred embodiment of the present invention.

Referring to FIG. 1, a lock-controlled drawer slide structure of the present invention comprises a lock device 1, a steel rope 2, and a latch device 3, wherein the constituted structure is connected with an interlocking device 4 such that the lock device 1 can lock or unlock the drawers. The steel rope 2 is located between the lock device 1 and the latch device 3, wherein the steel rope 2 can drive the latch device 3 for locking or unlocking the drawers by locking or unlocking the lock device 1.

Figure 2:
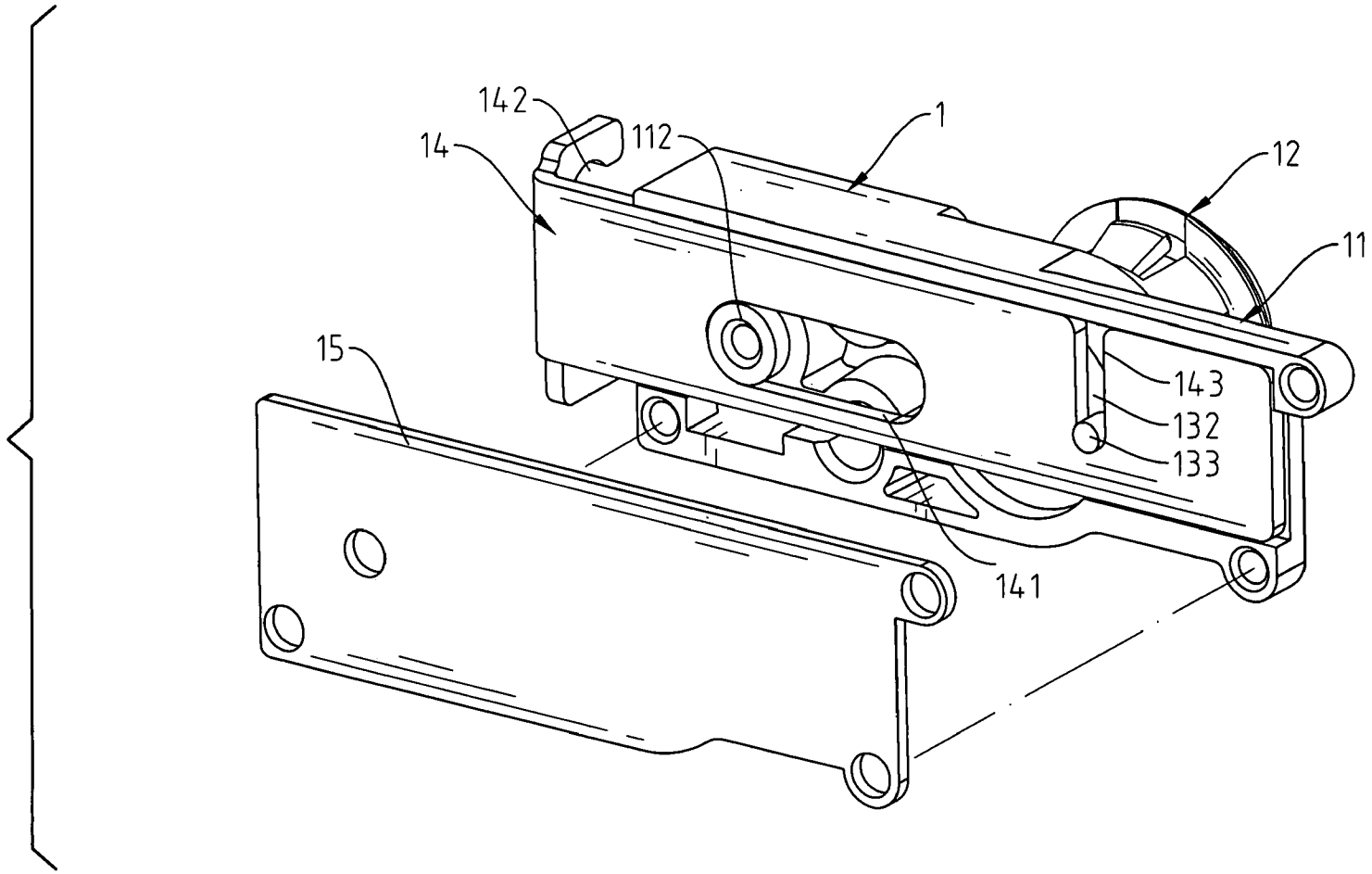
FIG. 2 is a three-dimensional, assembled view showing the lock device of the present invention.
Figure 3:
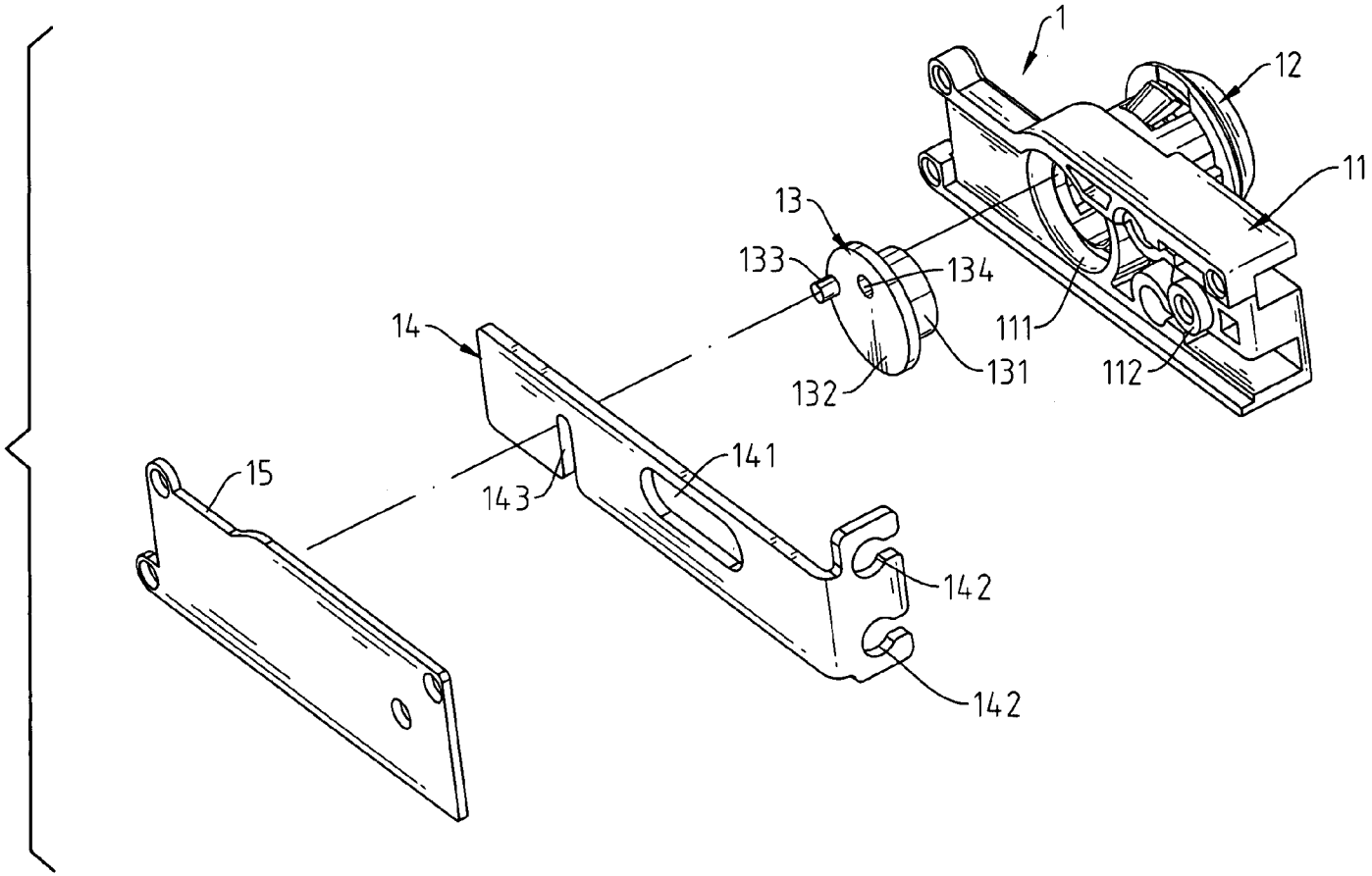
FIG. 3 is an exploded view showing the lock device of the present invention.
Figure 4:
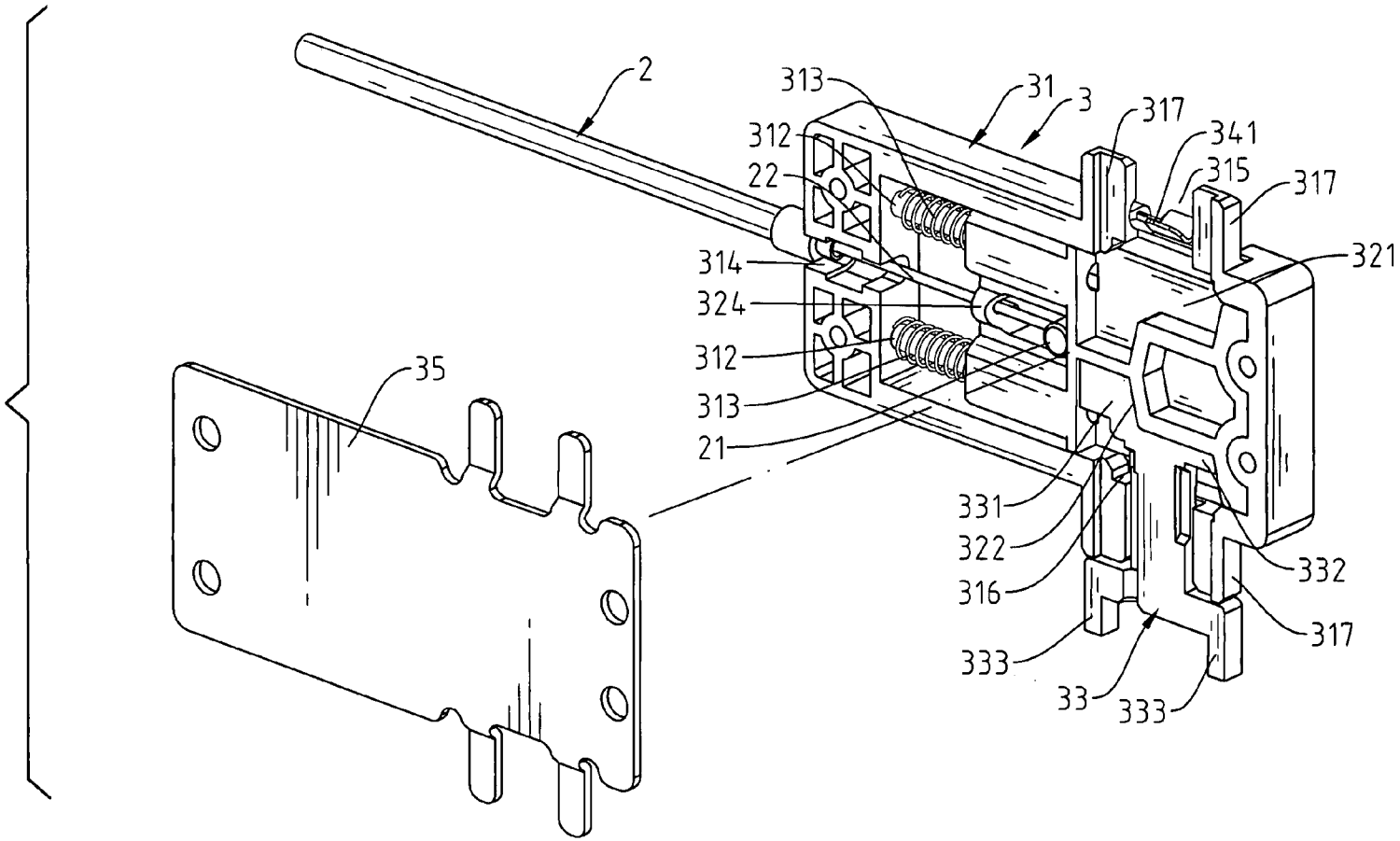
FIG. 4 is a three-dimensional, assembled view showing the latch device of the present invention.

Referring to FIG. 1 through FIG. 3, the lock device 1 comprises a fixing main body 11, a lock head 12, a rotatory means 13, a pull plate 14, and a fixing plate 15, wherein the lock head 12 is mounted on the outside of the fixing main body 11. An operation trench 111 is formed on the inside of the fixing main body 11 for holding the rotatory means 13, and a guide pillar 112 is mounted near the operation trench 111. A main body 131 of the rotatory means 13 has a diameter dimension, which is different from that of an operation plate 132. The lock head 12 is designed to couple with a hole 134 of the rotatory means 13 such that the rotatory means 13 is driven when rotating the lock head 12. Besides, a pillar 133 is bias mounted on the operation plate 132. The pull plate 14 that can be coupled with the fixing main body 11 is movable. A hooking hole 142 is extendedly formed on one side of the pull plate 14. A long opening 141 and an open-ended trench 143 are formed on the pull plate 14. The long opening 141 is designed for holding the guide pillar 112 and the pillar 133 of the rotatory plate 13 is designed for penetrating through the open-ended trench 143 when the pull plate 14 is coupled with the fixing main body 11. After the above-mentioned components are positioned, the fixing plate 15 is fixed on the fixing main body 11 so as to position the rotatory means 13 and the pull plate 14.

Because the main body 131 of the rotatory means 13 and the operation plate 132 have different diameter dimensions from each other and the lock head 12 is rotated by an angle from the main body 131, the rotated angle of the operation plate 132 is larger than that of the main body 131. Besides, the rotation of the operation plate 132 also drives the pull plate 14. As a result, the operation plate 132, which is rotated increasingly, also shifts the pull plate 14, thereby pulling the steel rope 2, which hooks the hooking hole 142 of the pull plate 14.

Referring to FIG. 1, FIG. 4, FIG. 5, and FIG. 6, the latch device 3 comprises a base 31, a slidable means 32, a braking means 33, a fastening plate 34, and a cover 35, wherein an action chamber 311 is formed in the base 31 and a trench 314 is formed on one side of the action chamber 311. Besides, two axial pillars 312 are transversely mounted in the action chamber 311 near the trench 314, and two guide channels 315, which are constituted by two opposite lateral rails 317, are symmetrically formed on upper and lower portions of the other side of the action chamber 311. The axial pillars 312 are designed for holding elastic devices 313. The slidable means 32 is mounted in the action chamber 311, and the braking means 33 is mounted in one of the guide channels 315.

A slide trench 323 is formed on one side of the slidable means 32 for holding a fixing head 21 of the steel rope 2 such that the fixing head 21 is positioned by a fixing sleeve 324. Besides, the trench 314 that forms on the base 31 is also designed for positioning the steel rope 2. Moreover, two stair-shaped trenches 321 are symmetrically formed on the other side of the slidable means 32. The stair-shaped trenches 321 are designed for holding a top block 331 of the braking means 33.

The top block 331 is located on the upper portion of the braking means 33, and its shape is designed to match that of the stair-shaped trenches 321 such that the middle neck portion of the braking means 33 is movably embedded in the guide channel 315. Besides, a reverse U-shaped crotched rod 333 of the braking means 33 and located below the stair-shaped trenches 321.

After the above-mentioned components are positioned, the cover 35 is coupled with the base 31.

In addition, the location of the braking means 33 may be changed in accordance with the mounting directions of the interlocking device and the slide since the guide channels 315 and the stair-shaped trenches 321 are symmetrically formed on the base and the latch device 3, respectively.

Figure 5:
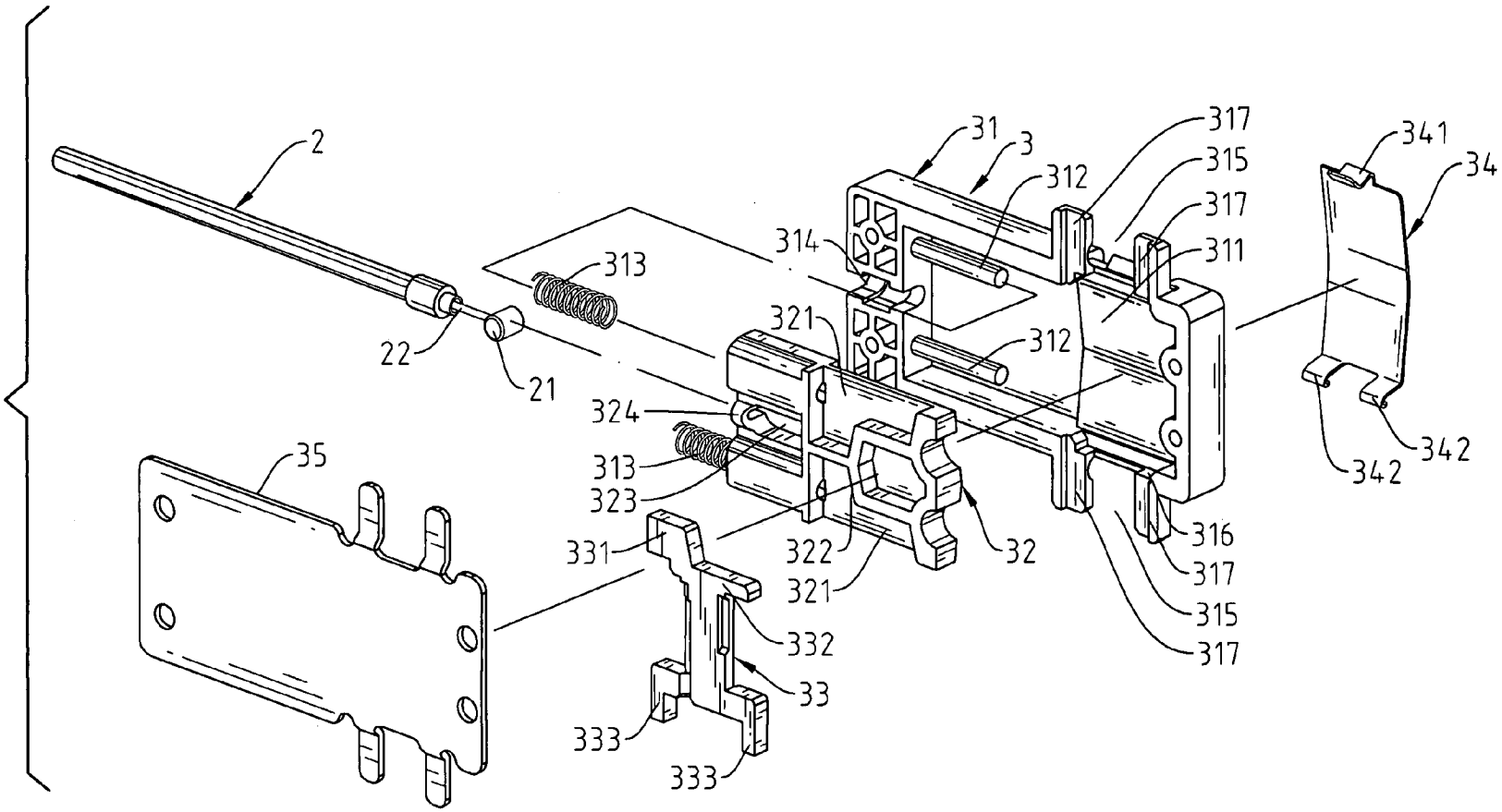
FIG. 5 is an exploded view showing the latch device of the present invention.
Figure 6:
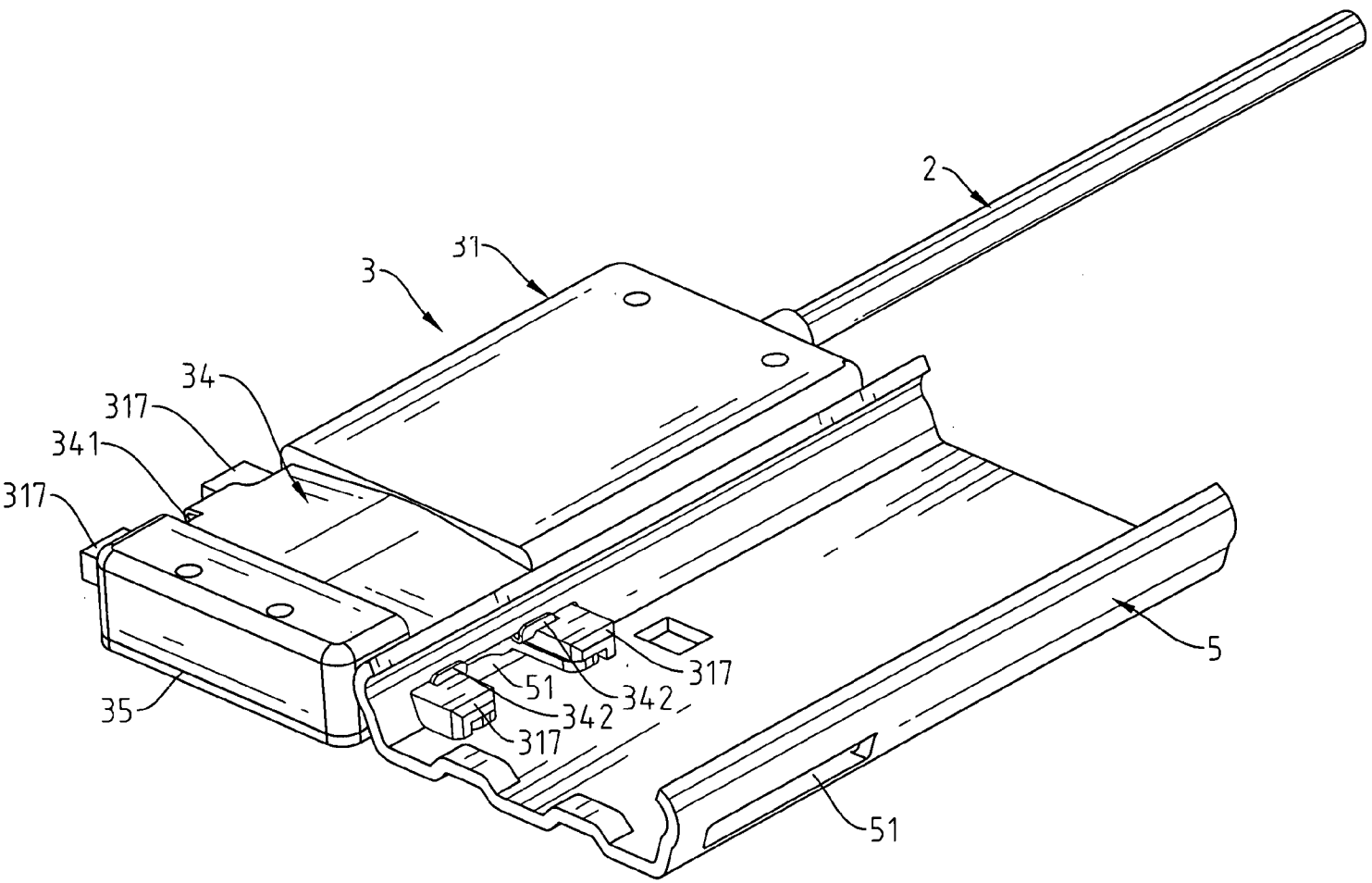
FIG. 6 is a three-dimensional view showing that the latch device is coupled to the slide in accordance with the present invention.
Figure 7:
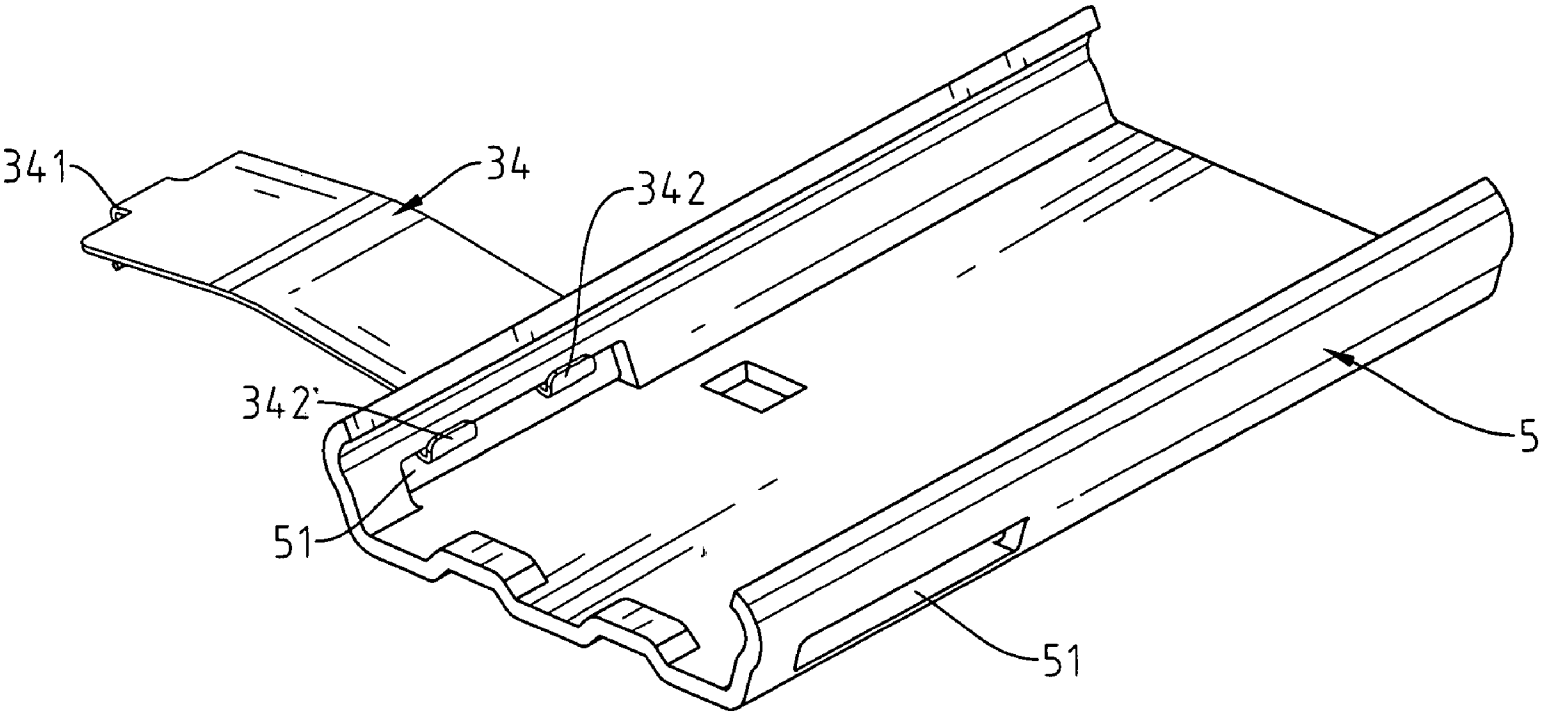
FIG. 7 is a three-dimensional view showing that the fastening plate is coupled to the slide in accordance with the present invention.

Referring to FIG. 5 through FIG. 7, a first hooking sheet 341 and two second hooking sheets 342 are mounted on both sides of the fastening plate 34, respectively, wherein the first hooking sheet 341 is designed to hook one of the guide channels 315, and these second hooking sheets 342 are located in the other guide channel 315 that locates adjacent to the slide 5. Besides, these second hooking sheets 342 are designed to hook a lateral trench 51 of the slide 5, and the lateral rails 317 of the base 31 can be inserted into the lateral trench 51 simultaneously. As a result, the latch device 3 can be securely coupled with the slide 5 by securely hooking the second hooking sheets 342 of the fastening plate 34 onto the lateral trench 51.

Figure 8:
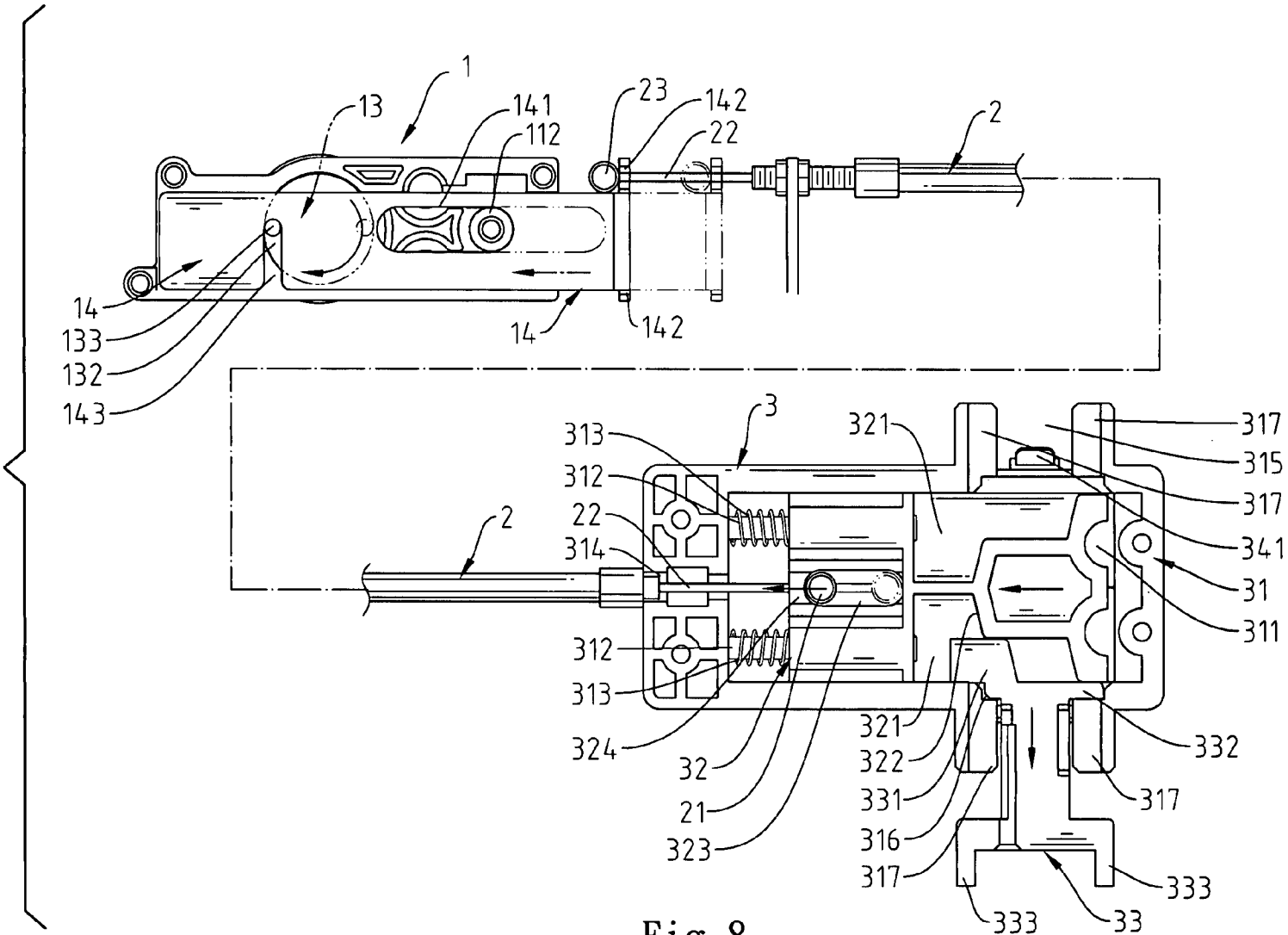
FIG. 8 is a schematic view showing that the lock device of the present invention is in lock-up state.
Figure 9:
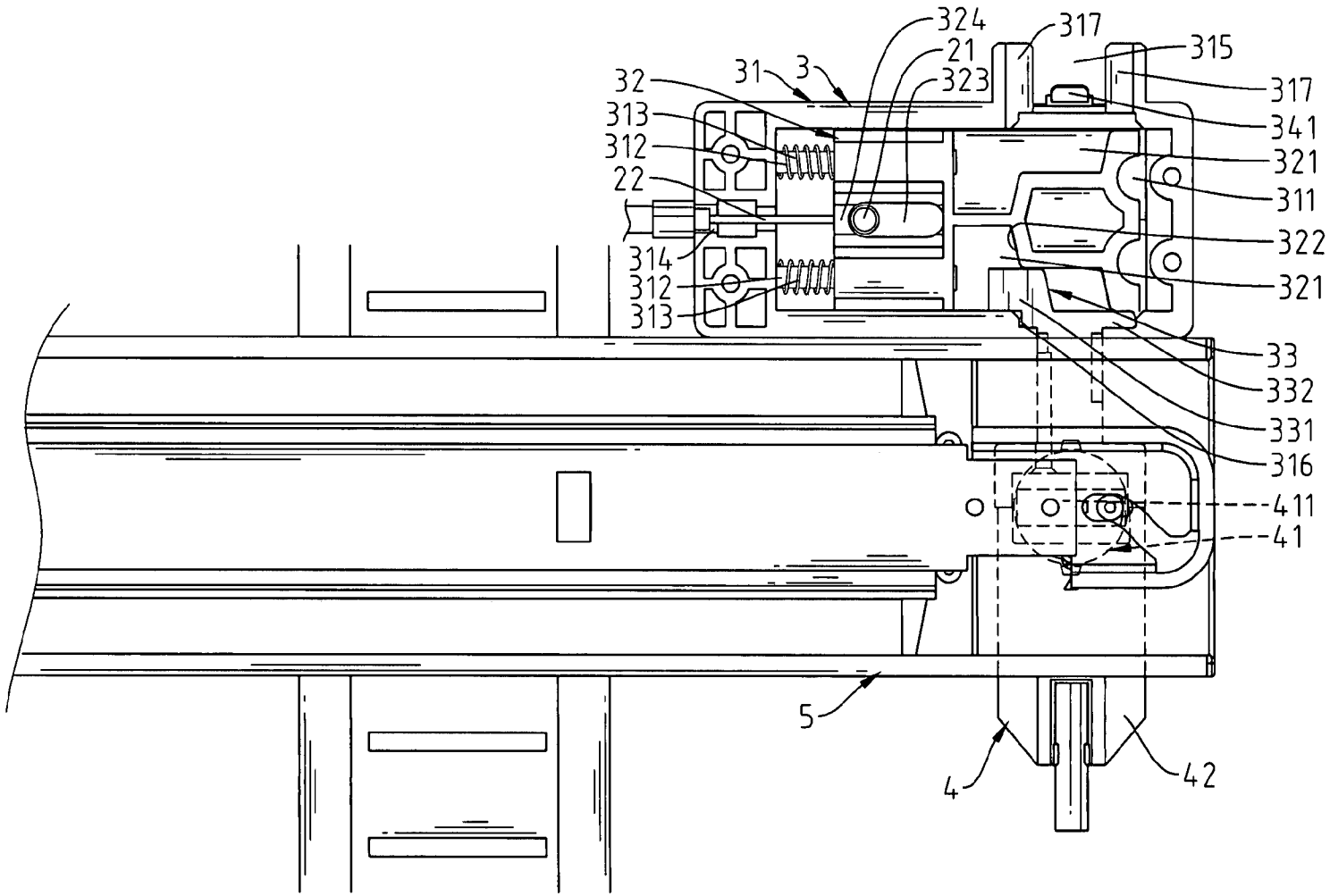
FIG. 9 is a schematic view showing that the interlocking device is driven by the lock device, which is in the lock-up state.

In addition, referring to FIG. 8 and FIG. 9, the control method of locking the drawers by using the lock device 1 and the latch device 3 is shown. When the lock device 1 is in lock-up state, the lock device 1 drives the rotatory means 13 for rotation such that the pillar 133 that mounts on the operation plate 132 drives the pull plate 14 simultaneously for making a long-distance displacement. As a result, the displacement of the pull plate 14 can also shift the steel rope 2 that hooks the hooking hole 142 of the pull plate 14 via a fixing head 23. Consequently, the steel rope 2 also shifts the slidable means 32 that mounts in the latch device 3. When the slidable means 32 is shifted, the braking means 33 is braked by the slidable means 32 so as to push the top block 331 of the braking means 33 downward along a bevel edge 322 of the stair-shaped trenches 321 until it is back into a receiving trench 316. Besides, the slidable means 32 is located to press the top of the top block 331 of the braking means 33, and the crotched rod 333 of the braking means 33 is located to block both sides of a push block 411 of a rotatory cam 41 of the interlocking device 4, whereby the braking means 33 and the rotatory cam 41 are unmovable. Because the crotched rod 333 is inserted into the action space between the rotatory cam 41 and a braking slide 42, the braking slide 42 is unmovable. As a result, these drawers are locked and prohibited from being opened.

Nevertheless, the above-mentioned interlocking device 4 is conventional, so the redundant description about its detailed structure and movement is omitted herein.

The invention claimed is:

1. A lock-controlled drawer slide structure connected with an interlocking device for locking or unlocking a plurality of drawers, the lock-controlled drawer slide structure comprising:

a) a lock device having:
  i) a fixing main body;
  ii) a rotatory device having an operation plate and a pillar connected to the operation plate;
  iii) a lock head mounted on an outside of the fixing main body and controlling a rotation of the rotatory device;
  iv) a pull plate having a hooking hole, an opening, and an open-ended trench, the pillar of the rotatory device is inserted through the open-ended trench; and
  v) a fixing plate;

b) a steel rope comprising two fixing heads, a first fixing head of the two fixing heads is connected to the hooking hole of the pull plate; and c) a latch device having:
  i) a slidable device having a slide trench formed on a first side thereof and two stair-shaped trenches symmetrically formed on a second side thereof, the slide trench holding a second fixing head of the two fixing heads of the steel rope;
  ii) a base having an action chamber, the slidable device is slidably located in the action chamber, two axial pillars are transversely mounted in a first side of the action chamber, two guide channels constituted by two opposite lateral rails are symmetrically formed on upper and lower portions of a second side of the action chamber;
  iii) two elastic devices, one of the two elastic devices is located on each of the two axial pillars;
  iv) a braking device having a top block, a middle neck portion, and a reverse U-shaped crotched rod, the top block is inserted into one of the two stair-shaped trenches, the middle neck portion is movably embedded in one of the guide channels, the reverse U-shaped crotched rod is located on a lower portion of the braking device;
  v) a fastening plate mounted on an outside of the base and fixing the latch device on a slide, the fastening plate having a first hooking sheet and two second hooking sheets are mounted on opposing sides of the fastening plate, the first hooking sheet is hooked to one of the guide channels and the second hooking sheets are adapted to be hooked to a lateral trench of the slide securely coupling the latch device with the slide; and
  vi) a cover connected to the base.

2. The lock-controlled drawer slide structure according to claim 1, wherein a main body of the rotatory device has a diameter different from a diameter of the operation plate of the rotatory device.

* * * * *